US010595119B2

(12) United States Patent
Cambrell et al.

(10) Patent No.: US 10,595,119 B2
(45) Date of Patent: Mar. 17, 2020

(54) APPARATUS FOR MANAGING DISTORTION IN A SIGNAL PATH AND METHOD

(71) Applicant: Blueprint Acoustics Pty Ltd, Endeavour Hills, Victoria (AU)

(72) Inventors: Gregory K. Cambrell, Mulgrave (AU); Zeljko Velican, Endeavour Hills (AU)

(73) Assignee: Blueprint Acoustics Pty Ltd (AU)

( * ) Notice: Subject to any disclaimer, the term of this patent is extended or adjusted under 35 U.S.C. 154(b) by 143 days.

(21) Appl. No.: 15/560,358

(22) PCT Filed: Jun. 30, 2017

(86) PCT No.: PCT/AU2017/050677
§ 371 (c)(1),
(2) Date: Sep. 21, 2017

(87) PCT Pub. No.: WO2018/023150
PCT Pub. Date: Feb. 8, 2018

(65) Prior Publication Data

US 2018/0255391 A1 Sep. 6, 2018

(30) Foreign Application Priority Data

Aug. 1, 2016 (AU) ..... 2016903021
Jun. 23, 2017 (AU) ..... 2017902425

(51) Int. Cl.
*H04R 1/26* (2006.01)
*H04R 3/14* (2006.01)
(Continued)

(52) U.S. Cl.
CPC ..... *H04R 1/26* (2013.01); *H04R 1/227* (2013.01); *H04R 3/12* (2013.01); *H04R 3/14* (2013.01);
(Continued)

(58) Field of Classification Search
CPC . H04R 1/26; H04R 1/227; H04R 3/12; H04R 3/14; H04R 5/02; H04R 2201/403;
(Continued)

(56) References Cited

U.S. PATENT DOCUMENTS 4,700,390 A * 10/1987 Machida ..... G10L 21/038 381/28
5,521,330 A * 5/1996 Kuwano ..... G10H 1/02 84/662
(Continued)

OTHER PUBLICATIONS

George Grammer, "Post-Phasing Distortion", Single Sideband for the Radio Amateur, Publication No. 20 of the Radio Amateur's Library published by the American Radio Relay League (ARRL), 1954, pp. 94-95 (first published in QST, Feb. 1954).
(Continued)

*Primary Examiner* — Davetta W Goins
*Assistant Examiner* — Daniel R Sellers
(74) *Attorney, Agent, or Firm* — Lerner, David, Littenberg, Krumholz & Mentlik, LLP

(57) ABSTRACT

Apparatus for managing and/or reducing harmonic distortion arising with an audio signal including a phase generator for generating at least one phase-difference signal or a reference audio signal generated by the phase generator, wherein the or each constant phase difference is adapted to provide cancellation of the harmonic distortion components arising along the signal path. Respective amplifier channels for receiving and separately amplifying the audio signal acting as a reference audio signal are also provided as are respective loudspeaker channels for receiving and separately producing sound corresponding to the amplified audio wherein each loudspeaker channel has substantially equal performance parameters and is adapted to radiate the sound relative to other loudspeaker channels to produce a combined sound that corresponds to the audio signal with
(Continued)

harmonic distortion components that are reduced compared to the harmonic distortion components arising along the signal path.

50 Claims, 8 Drawing Sheets

(51) Int. Cl.
*H04R 5/02* (2006.01)
*H04R 3/12* (2006.01)
*H04R 1/22* (2006.01)

(52) U.S. Cl.
CPC ..... *H04R 5/02* (2013.01); *H04R 2201/403* (2013.01); *H04R 2203/12* (2013.01); *H04S 2400/09* (2013.01)

(58) Field of Classification Search
CPC ..... H04R 2203/12; H04S 5/00; H04S 5/005; H04S 5/02; H04S 2400/09; G10K 11/178; G10K 15/02; G10H 2210/301
USPC ..... 381/335
See application file for complete search history.

(56) References Cited

U.S. PATENT DOCUMENTS 5,537,479 A * 7/1996 Kreisel ..... H04R 1/02 381/89
6,801,631 B1 * 10/2004 North ..... H04R 1/26 181/148
2010/0220871 A1 * 9/2010 Mitsuhashi ..... H04R 1/403 381/97
2012/0033829 A1 * 2/2012 Lewis ..... H04R 3/04 381/97

OTHER PUBLICATIONS

Webster, D., Scott, J. And Haigh, D., "Control of Circuit Distortion by the Derivative Superposition Method", IEEE Microwave and Guided Wave Letters, vol. 6, No. 3, Mar 1996, pp. 123-125.

* cited by examiner

APPARATUS FOR MANAGING DISTORTION IN A SIGNAL PATH AND METHOD

CROSS-REFERENCE TO RELATED APPLICATIONS

The present application is a national phase entry under 35 U.S.C § 371 of International Application No. PCT/AU2017/050677 filed Jun. 30, 2017, which claims priority from Australian Application Nos. 2016903021 filed Aug. 1, 2016 and 2017902425, filed Jun. 23, 2017, all of which are hereby incorporated herein by reference.

TECHNICAL FIELD

The present invention relates to a system for reproducing sound with high fidelity and in particular relates to apparatus and a method for managing and/or reducing harmonic distortion in a signal path associated with an audio signal or system such as a sound reproducing system.

Definitions

Audio Signal

An audio signal denotes a representation of a sound wave or acoustic wave that may appear in any solid, liquid or gaseous medium. It may include a waveform that may appear in any physical domain including electrical, mechanical and acoustical domains. The waveform may include a continuous (analog), sampled or digitized function of time and may include components of any frequency including infrasonic, audible and ultrasonic frequencies.

Phase Generator

A phase generator denotes a device that generates one or more versions of an audio signal wherein all frequency components (in an operating frequency band) of each version differ in phase by a constant phase angle from corresponding frequency components in a reference audio signal. In mathematics a phase-transformed version of a signal waveform wherein phase angles of all components of the signal are shifted by 90 degrees is known as the Hilbert Transform. A complex-valued function of time having its real part equal to the original signal waveform and its imaginary part equal to the Hilbert Transform of the original signal waveform is known as the Analytic Signal.

A phase generator according to the present invention may include a poly-phase generator wherein constant phase-angle differences between each version of an audio signal may be selected angles that are not necessarily equal to 90 degrees. A phase-transformed version of a signal waveform with a constant phase-angle difference between 0 degrees and 360 degrees (modulo 360 degrees) may be generated from a suitable linear combination of just two versions of the signal waveform, namely, the original signal waveform and its Hilbert Transform (also known as a quadrature signal waveform), by using the trigonometric identity $$\sin(\alpha+\beta)=\sin\alpha\cdot\cos\beta+\cos\alpha\cdot\sin\beta$$

or its complex version $$\exp(j(\alpha+\beta))=\exp(j\alpha)\cdot\cos\beta+j\exp(j\alpha)\cdot\sin\beta.$$

Reference Audio Signal/channel/phase

A reference audio signal denotes an audio signal which passes through a signal path that exhibits an agreed or reference phase response. It may include an input audio signal or a version of an input audio signal wherein the phase angles of its frequency components are shifted to a reference phase over an operating frequency band. The phase of an audio signal denotes the collective phase angles of each of its frequency components with respect to an agreed time origin.

The signal path, and subsequent paths through which the reference audio signal passes, may be referred to as a reference channel, and the reference channel may be labelled as having a reference phase of 0 degrees. A reference audio signal may also include an audio signal whose frequency components have not been shifted in phase over an operating frequency band.

Phase Response

A phase response of a signal path denotes a phase shift experienced by a sinusoidal signal when the latter passes through a signal path. The phase response includes a transfer function that compares output with input and includes a function of frequency of the sinusoid.

Operating Frequency Band

An operating frequency band denotes a frequency band over which a phase generator may operate and/or a reference audio signal may be generated by a phase generator and may include sub-bands such as bass and/or treble sub-bands. In an audio context the operating frequency band may include frequencies at least between 20 Hz and 20 kHz.

BACKGROUND OF INVENTION

Distortion in an audio system may occur in various forms including analog and/or digital distortion in amplifiers and signal processors. Analog distortion may include harmonic distortion in amplifiers and loudspeakers, intermodulation distortion in amplifiers and loudspeakers, and crossover distortion in push-pull amplifiers.

One form of analog distortion that is difficult to eradicate is harmonic distortion. Harmonic distortion occurs in amplifiers, signal processors and loudspeakers. Many scientific studies have sought to isolate the causes of harmonic distortion and some causes have been identified including non-linearity in transfer function(s) associated with one or more parts of a system. For example, harmonic distortion in a loudspeaker driver may include distortion due to mechanical non-linearity of an associated diaphragm suspension, hysteresis in an associated magnetic circuit, back emf associated with a voice coil and/or a voice coil that operates outside of its linear excursion range.

However, it has also been assumed that a substantially distortion-free amplifier driving a substantially distortion-free loudspeaker driver should result in little or no distortion. Accordingly, most research effort has been applied to locating and correcting distortion in amplifiers and loudspeaker drivers. It has not been appreciated that the assumption may be incorrect and/or that a further cause of distortion in a loudspeaker system may be due to interaction between the driver of the loudspeaker system and its enclosure including non-linear compression of air both inside the loudspeaker enclosure and outside the enclosure including around an area of radiation. Non-linear compression of air may generate mostly Second-order harmonic distortion components in the acoustic output of a loudspeaker system. The latter distortion components may also increase with sound pressure level (SPL).

Moreover, harmonic distortion components caused by non-linear compression of air is in addition to harmonic distortion components arising from an amplifier, a loudspeaker driver and/or other components of a loudspeaker system. As noted above, a loudspeaker system with substantially distortion-free components may still generate distortion. Solutions attempted in the prior art to address this problem include use of motional feedback, pre-distortion compensation and pre-distortion compensation with feedback. However, motional feedback cannot correct distortion that is generated in an audio signal path beyond the cone of a loudspeaker driver, while analog pre-distortion compensation cannot store enough data to predict the distortion sufficiently to fully compensate or cancel the distortion. Digital pre-distortion compensation may be subject to digital distortion and may also require extremely fast processing. Pre-distortion also has a disadvantage in that it has to be matched to a loudspeaker system.

The present invention may be adapted to manage and/or at least reduce Second-order and/or Third-order components of harmonic distortion including distortion components arising from non-linear compression of air and/or other causes without using feedback and without being matched to a loudspeaker system.

A reference herein to a patent document or other matter which is given as prior art is not to be taken as an admission that that document or matter was known or that the information it contains was part of the common general knowledge in Australia or elsewhere as at the priority date of any of the disclosures or claims herein. Such discussion of prior art in this specification is included to explain the context of the present invention in terms of the inventor's knowledge and experience.

Throughout the description and claims of this specification the words "comprise" or "include" and variations of those words, such as "comprises", "includes", "comprising" or "including", are not intended to exclude other additives, components, integers or steps.

SUMMARY OF INVENTION

According to one aspect of the present invention there is provided apparatus for managing and/or reducing harmonic distortion components arising along a signal path associated with an audio signal or audio system, said apparatus comprising:

a phase generator for generating at least one phase-difference signal being a version of said audio signal that has a constant difference in phase relative to said audio signal acting as a reference audio signal, or a reference audio signal generated by the phase generator, wherein the or each constant phase difference is adapted to provide cancellation of said harmonic distortion components arising along said signal path;

respective amplifier channels for receiving and separately amplifying said audio signal acting as a reference audio signal, or said reference audio signal generated by the phase generator, and the or each version of said audio signal, wherein each amplifier channel has substantially-equal gain and/or performance parameters; and respective loudspeaker channels for receiving and separately producing sound corresponding to the amplified audio signal acting as a reference audio signal, or reference audio signal generated by the phase generator, and the or each amplified version of said audio signal, wherein each loudspeaker channel has substantially-equal performance parameters and is adapted to radiate said sound relative to other loudspeaker channels to produce a combined sound that corresponds to said audio signal with harmonic distortion components that are reduced compared to said harmonic distortion components arising along said signal path.

The reference audio signal may include a version of the audio signal whose frequency components have a reference phase. The phase generator may be adapted to generate one version of the audio signal that is shifted in phase by 90 degrees relative to the audio signal acting as a reference audio signal, or the reference audio signal generated by the phase generator, to provide substantially complete cancellation of Second-order harmonic distortion components using two channels.

The phase generator may be adapted to generate one version of the audio signal that is shifted in phase by a first angle relative to the audio signal acting as a reference audio signal, or the reference audio signal generated by the phase generator, to provide at least partial cancellation of both Second-order and Third-order harmonic distortion components using two channels.

The phase generator may be adapted to generate two versions of the audio signal that are shifted in phase by 60 degrees and 120 degrees respectively relative to the audio signal acting as a reference audio signal, or the reference audio signal generated by the phase generator, to provide substantially complete cancellation of Second-order harmonic distortion components and at least partial cancellation of Third-order harmonic distortion components using three channels.

The phase generator may be adapted to generate two versions of the audio signal that are shifted in phase by first and second angles relative to the audio signal acting as a reference audio signal, or the reference audio signal generated by the phase generator, to provide partial cancellation of both Second-order and Third-order harmonic distortion components using three channels.

The phase generator may be adapted to generate three versions of the audio signal that are shifted in phase by 60 degrees, 90 degrees and 150 degrees respectively relative to the audio signal acting as a reference audio signal, or the reference audio signal generated by the phase generator, to provide substantially complete cancellation of both Second-order and Third-order harmonic distortion components using four channels.

The phase generator may be adapted to generate three versions of the audio signal that are shifted in phase by first, second and third angles relative to the audio signal acting as a reference audio signal, or the reference audio signal generated by the phase generator, to provide substantially complete cancellation of two orders of harmonic distortion components using four channels.

Each loudspeaker channel may include a direct radiator and may be oriented towards an audience. In some embodiments the loudspeaker channels may be oriented towards each other to assist with mixing outputs to form a common acoustic wave output to a listening environment. In some embodiments the loudspeaker channels my radiate into a plenary chamber where acoustic waves from the channels are mixed prior to radiation into a listening environment. Each loudspeaker channel may radiate from a port and the ports may be located adjacent to each other.

In some embodiments the phase generator may include an analog circuit. In some embodiments the phase generator may include a digital signal processor (DSP). Each amplifier channel may drive multiple loudspeaker drivers in arrays of multiple sets of loudspeakers. Each loudspeaker channel may include a line array and each alternate loudspeaker channel may have its output shifted in phase by a different angle from a preceding one. Each loudspeaker channel may include a closed box construction. Each loudspeaker channel may operate over a frequency band that includes a rising acoustic frequency response which is actively equalized.

The phase difference may be adapted to switch from 90 degrees at a relatively low power level to 60 degrees at a relatively high power level; the power level that determines switching may correspond to a transition between dominant Second-order harmonic distortion components and dominant Third-order harmonic distortion components. The phase difference may transition gradually from 90 degrees to 60 degrees as power level increases.

The phase difference may transition gradually from 90 degrees to 60 degrees as a non-constant function of the frequencies present in the audio signal.

Each loudspeaker channel may include technology of any known type including electromagnetic, magnetostatic, electrostatic, piezoelectric, electrostrictive, magnetostrictive, infinite baffle, closed box, vented box, passive-radiator box, dipolar and bipolar to produce subsonic, audible or ultrasonic sound in any gaseous, fluid or solid media. Loudspeakers in this context may include headphones, hearing aids, underwater transducers, transducers intended for other gaseous, fluid or solid media, and/or other transducers intended to reproduce audio sounds including subsonic and ultrasonic transducers.

According to a further aspect of the present invention, there is provided a method for managing and/or reducing harmonic distortion components arising along a signal path associated with an audio signal or audio system, said method comprising:

generating at least one phase-difference signal being a version of said audio signal that has a constant difference in phase relative to said audio signal acting as a reference audio signal, or a reference audio signal generated by the phase generator, wherein the or each constant phase difference is adapted to provide cancellation of said harmonic distortion components arising along said signal path;

separately amplifying said audio signal acting as a reference audio signal, or said reference audio signal generated by the phase generator, and the or each version of said audio signal via respective amplifier channels, wherein each amplifier channel has substantially-equal gain and/or performance parameters; and separately producing sound corresponding to the amplified audio signal acting as a reference audio signal, or reference audio signal generated by the phase generator, and the or each amplified version of said audio signal via respective loudspeaker channels, wherein each loudspeaker channel has substantially-equal performance parameters and radiates said sound relative to other loudspeaker channels to produce a combined sound that corresponds to said audio signal with harmonic distortion components that are reduced compared to said harmonic distortion components arising along said signal path.

According to a further aspect of the present invention, there is provided apparatus for processing a signal such as an audio signal that is subject to harmonic distortion components arising along a signal path associated with a system such as an audio system, said apparatus comprising:

a phase generator for generating at least one phase-difference signal being a version of said audio signal that has a constant difference in phase relative to said audio signal acting as a reference audio signal, or a reference audio signal generated by the phase generator, wherein the or each constant phase difference is adapted to provide cancellation of said harmonic distortion components arising along said signal path; and wherein said reference audio signal and each version of said audio signal are adapted to produce a combined sound that corresponds to said audio signal with harmonic distortion components that are reduced compared to said harmonic distortion components arising along said signal path.

According to a further aspect of the present invention, there is provided a method for processing a signal such as an audio signal that is subject to harmonic distortion components arising along a signal path associated with a system such as an audio system, said method comprising:

generating at least one phase-difference signal being a version of said audio signal that has a constant difference in phase relative to said audio signal acting as a reference audio signal, or a reference audio signal generated by the phase generator, wherein the or each constant phase difference is adapted to provide cancellation of said harmonic distortion components arising along said signal path; and providing an output including at least said audio signal acting as a reference audio signal, or said reference audio signal generated by the phase generator, and the or each version of said audio signal wherein said output is adapted to produce a combined sound that corresponds to said audio signal with harmonic distortion components that are reduced compared to said harmonic distortion components arising along said signal path.

According to a further aspect of the present invention, there is provided loudspeaker apparatus for managing and/or reducing harmonic distortion components associated with a signal such as an audio signal that is subject to harmonic distortion components arising along a signal path, said apparatus comprising:

a main enclosure including a plurality of substantially-equal compartments;

at least two drivers each having substantially-equal performance parameters and each being housed in a separate one of said equal compartments; and wherein each driver is adapted to be driven via a signal processed by an apparatus or a method as described above.

The loudspeaker apparatus may include two drivers wherein said drivers are adapted to be driven via signals using two channels including a reference channel and a channel having a phase response differing by 90 degrees from the phase response of the reference channel to provide substantially complete cancellation of Second-order harmonic distortion components.

The loudspeaker apparatus may include three drivers wherein said drivers are adapted to be driven via signals using three channels including a reference channel and two other channels having phase responses differing by 60 degrees and 120 degrees respectively from the phase response of the reference channel to provide substantially complete cancellation of Second-order harmonic distortion components and at least partial cancellation of Third-order harmonic distortion components.

The loudspeaker apparatus may include four drivers wherein said drivers are adapted to be driven via signals using four channels including a reference channel and three other channels having phase responses differing by 60 degrees, 90 degrees and 150 degrees respectively from the phase response of the reference channel to provide substantially complete cancellation of both Second-order and Third-order harmonic distortion components.

The drivers may be arranged in a rectangular formation such that the reference channel is diagonally opposite to the 150 degrees channel and the 60 degrees channel is diagonally opposite to the 90 degrees channel.

According to a further aspect of the present invention, there is provided a distortion-cancelling audio system comprising:

a phase generator for generating plural versions of an input audio signal including a reference audio signal and other signal versions which are shifted in phase relative to said reference audio signal;

a set of amplifiers for receiving said reference audio signal and said other signal versions having phase-shifted signals and for providing corresponding amplifier outputs; and a set of loudspeakers for receiving the amplifier outputs and for producing acoustic outputs, wherein each amplifier corresponds to an output from the phase generator and each loudspeaker corresponds to an amplifier such that each loudspeaker produces an acoustic output that has constant phase difference relative to the acoustic output of each other loudspeaker, and wherein the loudspeakers are combined into a composite structure such that their acoustic outputs are in close proximity to each other.

According to a further aspect of the present invention, there is provided a distortion-cancelling audio system comprising:

a phase generator for generating four versions of an input audio signal including a reference audio signal and three other signal versions which are shifted in phase by 60 degrees, 90 degrees and 150 degrees respectively relative to said reference audio signal, wherein each signal version is adapted to be stored in a multi-channel format;

a storage medium for storing said four signal versions in said multi-channel format;

a decoder for regenerating said four signal versions from said four stored signal versions;

a set of four amplifiers for receiving said four regenerated signal versions and for producing four amplifier outputs; and a set of four loudspeakers for receiving the four amplifier outputs, wherein the loudspeakers are arranged such that their acoustic outputs are in close proximity to each other.

The loudspeakers may be arranged in a rectangular formation such that a reference channel corresponding to said reference audio signal is diagonally opposite to the 150 degrees channel and the 60 degrees channel is diagonally opposite to the 90 degrees channel.

According to a further aspect of the present invention, there is provided a distortion-cancelling audio system comprising:

a phase generator for generating two versions of an input audio signal including a reference audio signal and another signal version which is shifted in phase by 90 degrees relative to said reference audio signal, wherein each signal version is adapted to be stored in a multi-channel format;

a storage medium for storing said two signal versions in said multi-channel format;

a decoder for regenerating said two signal versions from said two stored signal versions;

a set of two amplifiers for receiving said two regenerated signal versions and for producing two amplifier outputs; and a set of two loudspeakers for receiving the two amplifier outputs, wherein the loudspeakers are arranged such that their acoustic outputs are in close proximity to each other.

According to a further aspect of the present invention, there is provided a distortion-cancelling audio system comprising:

a phase generator for generating two versions of an input audio signal including a reference audio signal and another signal version which is shifted in phase by 90 degrees relative to said reference audio signal, wherein each signal version is adapted to be stored in a multi-channel format;

a storage medium for storing said two signal versions in said multi-channel format;

a decoder for regenerating said two signal versions from said two stored signal versions, wherein one regenerated signal is said reference audio signal and the other regenerated signal has a phase difference of 90 degrees;

a further phase generator or phase generators for generating two further phase-difference signals from said two regenerated signal versions, having phase differences of 60 degrees and 150 degrees respectively relative to said regenerated reference audio signal, thereby acquiring four phase-difference signals having relative phases of 0, 60, 90 and 150 degrees;

a set of four amplifiers for receiving the four regenerated phase-difference signals and for producing four amplifier outputs; and a set of four loudspeakers for receiving the four amplifier outputs wherein the loudspeakers are arranged such that their acoustic outputs are in close proximity to each other.

The loudspeakers may be arranged in a rectangular formation such that a reference channel corresponding to said reference audio signal is diagonally opposite to the 150 degrees channel and the 60 degrees channel is diagonally opposite to the 90 degrees channel.

According to a further aspect of the present invention, there is provided a data carrier or a storage device including or having stored therein a signal processed by an apparatus or a method as described above.

BRIEF DESCRIPTION OF DRAWINGS

Preferred embodiments of the present invention will now be described in detail with reference to the following diagrams wherein.

DETAILED DESCRIPTION

Figure 1:
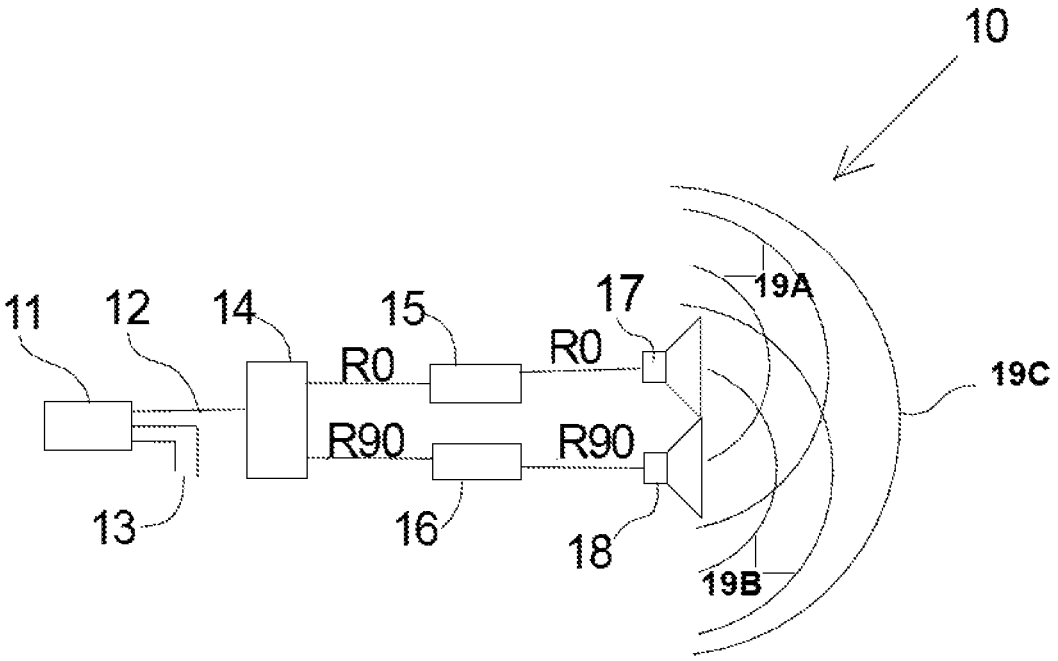
FIG. 1 shows a schematic representation of apparatus for cancelling distortion in a signal path according to one embodiment of the present invention.

Loudspeakers in general generate audible harmonic distortion. The present invention may provide a distortion reduction tool. In essence, apparatus according to the present invention may process an input audio signal, and reproduce from it new audio signals forming at least two new channels wherein the new audio signals have constant phase difference(s) across all frequencies of an operating frequency band. The new audio signals associated with the new channels may be applied to corresponding amplifiers and to corresponding loudspeakers to form an array wherein the outputs of the loudspeakers have relative phase difference(s).

The loudspeakers (and associated amplifiers) associated with the new channels may form substantially-identical parallel channels meaning that they may have the same performance parameters as each other and their outputs may be located as close as practicable to each other. If they include direct radiators their drivers may be adjacent facing an audience or they may be angled towards each other. If there are four of them their drivers may be arranged in a square pattern or a diamond pattern. Multiple sets of distortion-cancelling loudspeakers may be arranged in an array.

The loudspeaker drivers may be housed in closed boxes and they may have a rising frequency response which is actively equalized. Typically this may result in high distortion, but the distortion management system of the present invention may facilitate such an alignment without a distortion penalty. The loudspeaker drivers may be housed in closed boxes. The loudspeaker drivers may be housed in vented boxes with ports close to each other so that sound appears to radiate from a common point. The loudspeaker drivers may be housed in separate boxes, or separate compartments of a common box. If the loudspeakers employ infinite-baffle topology they may not need rear wave separation unless the rear waves are firing into a confined space. If the output of the loudspeakers is through ports the ports may be located close to each other. Such ports may be replaced by passive radiators or drones.

One reason for placing the ports close to each other or the drivers close to each other in the case of direct radiators is to cause acoustic radiation from the group of loudspeakers to appear to come from a common point to facilitate mixing of the acoustic radiation. In particular, the size and arrangement of drivers may be frequency dependent. As a general rule the higher is the operating frequency, the closer the drivers should be relative to each other. Accordingly, the array may be fed into a plenary chamber to unite acoustic outputs of the array so that only a common acoustic wave enters a listening environment.

When recombined, the outputs of the substantially-identical parallel channels may cause cancellation of harmonic distortion components arising in amplifiers and loudspeakers and/or other components of the parallel channels including signal processors, but they cannot cancel distortion that was present before the point of creation of the parallel channels. There is a region close to individual drivers prior to the acoustic waves uniting where distortion due to air compression is also cancelled. The technology of the present invention may be used in combination with other distortion minimizing measures.

In one embodiment the number of substantially-identical parallel channels per input may be two and the relative phase difference may be 90 degrees to provide theoretically complete cancellation of Second-order harmonic distortion components. However, a relative phase difference within the range 55 to 95 degrees may be selected to provide a choice of degree of cancellation of both Second-order and Third-order harmonic distortion components. Multiple sets of two-channel distortion-cancelling systems may be arranged in a line array wherein each alternate loudspeaker output has a phase difference within a range of 55 to 95 degrees from the preceding one.

In another embodiment the number of substantially-identical parallel channels may be three and the relative phase differences may be 60 degrees and 120 degrees to provide theoretically complete cancellation of Second-order harmonic distortion components along with partial cancellation of Third-order harmonic distortion components. The relative phase differences may be adjusted to provide partial cancellation of both Second-order and Third-order harmonic distortion components.

In a further embodiment the number of substantially-identical parallel channels may be four and the relative phase differences may be 60 degrees, 90 degrees and 150 degrees to provide theoretically complete cancellation of both Second-order and Third-order harmonic distortion components.

A phase generator may be provided via an analog circuit and/or a digital signal processor.

FIG. 1 shows an overview of a distortion management system 10 according to one embodiment of the present invention with functionality to cancel Second-order harmonic distortion components. A signal source 11 such as a CD player includes a number of output channels 12, 13. The output channels may include left and right stereo channels, for example. The distortion management system may be applied to one or more of these channels. A separate distortion management system (not shown) may be applied to each channel 13.

FIG. 1 shows one channel 12 connected to a phase generator 14 which regenerates channel 12 as two separate channels R0 and R90. Channel R0 provides a reference audio signal and channel R90 provides a version of the audio signal that is shifted in phase by 90 degrees relative to channel R0 across an operating frequency band.

The signals associated with channels R0 and R90 may be amplified via separate substantially-identical amplifiers 15, 16 and the amplified signals may be applied to separate substantially-identical loudspeakers 17, 18 to produce corresponding sound waves 19A, 19B. Loudspeakers 17, 18 may be arranged to face toward a listener (not shown) so that sound waves 19A, 19B may mix or combine to produce resultant sound waves 19C that are substantially a combination of sound waves 19A, 19B. As explained below the resultant sound waves 19C may correspond to the input audio signal in channel 12 with harmonic distortion that is reduced compared to harmonic distortion arising in the signal path of each substantially-identical amplifier-loudspeaker channel.

If the signal path associated with channel R0 causes harmonic distortion of an original fundamental signal from channel 12, and if the signal path associated with channel R90 causes a substantially similar harmonic distortion of the original fundamental signal from channel 12, a phase shift of 90 degrees of the fundamental components is equivalent to a phase shift of 180 degrees of the Second-order harmonic distortion components. Since two signals of equal magnitude that are 180 degrees apart will combine destructively, the resultant sound waves 19C produced by loudspeakers 17, 18, will contain effectively cancelled Second-order harmonic distortion components. At the same time, fundamental components may combine constructively in the resultant sound waves 19C produced by loudspeakers 17, 18 to reproduce the original fundamental signal with integrity, albeit with a 3 dB loss of SPL compared to two similar loudspeakers operating in phase.

In the case of cancelling Second-order harmonic distortion components, the input audio signal may be reproduced in two channels with a 90 degrees phase difference between them. Only two channels may be required. A two-channel embodiment may be particularly suitable for loudspeaker systems wherein Third-order and higher-order harmonic distortion components are already inaudible due to other distortion control measures.

In the case of cancelling Second-order and some higher-order harmonic distortion components regardless of their source within parallel signal paths, four channels with phase differences of 60 degrees, 90 degrees and 150 degrees may provide an optimum value solution. This latter embodiment may operate in a similar way to provide substantial cancellation of Second-order, Third-order and some higher-order harmonic distortion components and at least partial cancellation of intermodulation distortion products.

Two-channel embodiments and four-channel embodiments may be recommended as having an optimum value for cost. However, any number of channels greater than one may be adopted.

Figure 2:
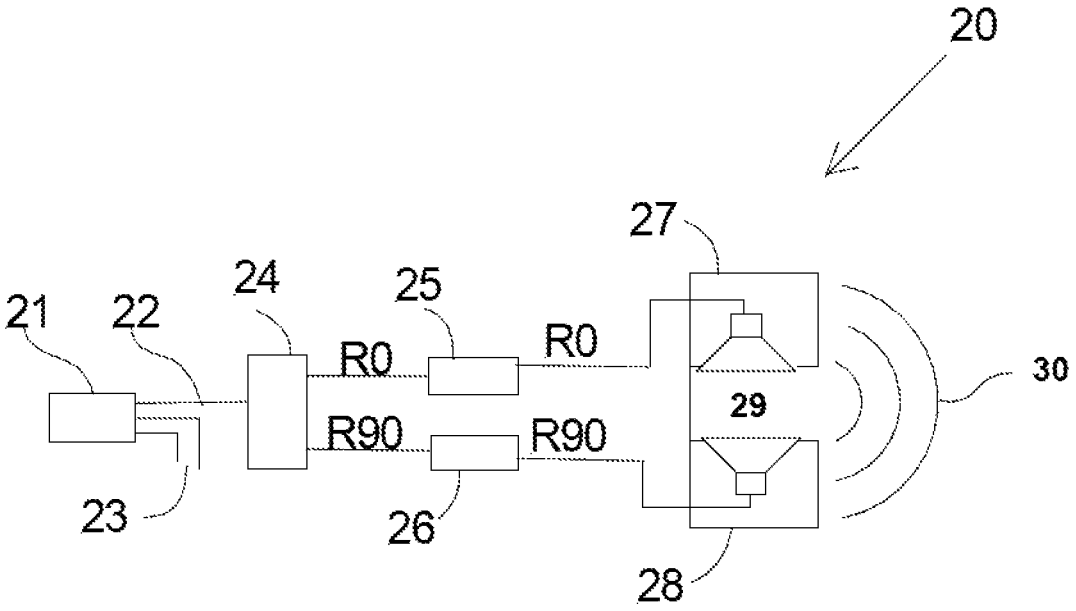
FIG. 2 shows a schematic representation of apparatus for cancelling distortion in a signal path according to another embodiment of the present invention.

FIG. 2 shows an overview of a distortion management system 20 according to another embodiment of the present invention with functionality to cancel Second-order harmonic distortion components. A signal source 21 such as a CD player includes a number of output channels 22, 23. The output channels may include left and right stereo channels, for example. The distortion management system may be applied to one or more of these channels. A separate distortion management system (not shown) may be applied to each channel 23.

FIG. 2 shows one channel 22 connected to a phase generator 24 which regenerates channel 22 as two separate channels R0 and R90. Channel R0 provides a reference audio signal and channel R90 provides a version of the audio signal that is shifted in phase by 90 degrees relative to channel R0 across an operating frequency band.

The signals associated with channels R0 and R90 may be amplified via separate substantially-identical amplifiers 25, 26 and the amplified signals may be applied to separate substantially-identical loudspeakers 27, 28 to produce corresponding sound waves. In this configuration loudspeakers 27, 28 may be arranged to face into a common plenum 29 wherein mixing of sound waves from loudspeakers 27, 28 may take place to produce resultant sound waves 30 that are substantially a combination of sound waves produced by loudspeakers 27, 28. As explained above the resultant sound waves 30 may correspond to the input audio signal in channel 22 with harmonic distortion that is reduced compared to harmonic distortion arising in the signal path of each substantially-identical amplifier-loudspeaker channel.

The arrangement of FIG. 2 may provide improved mixing of phase-shifted acoustic outputs because, in the arrangement of FIG. 1, off-axis acoustic radiation may vary in the degree of harmonic cancellation at different angles relative to the axis of radiation.

Figure 3:
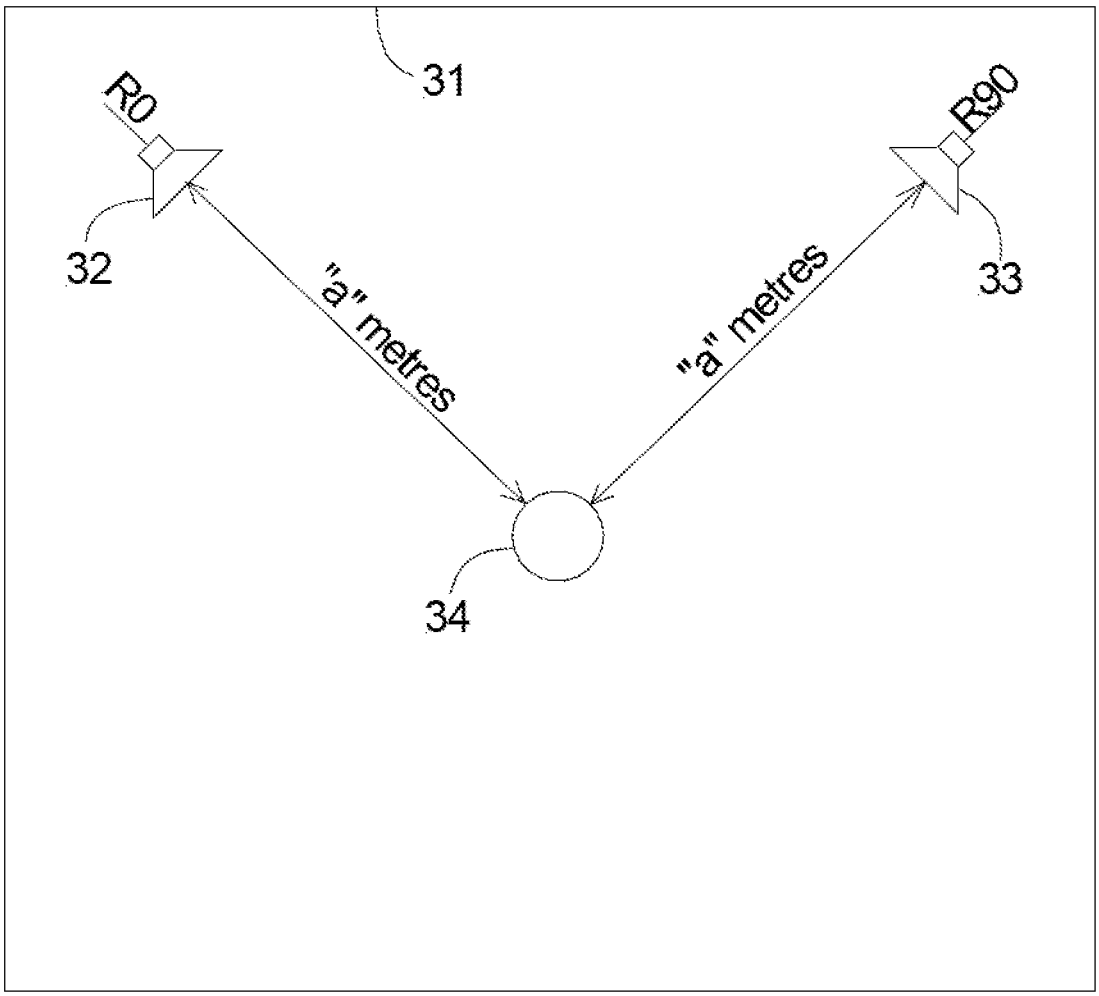
FIG. 3 shows a modification of the apparatus of FIG. 1.

FIG. 3 shows a modification of the apparatus shown in FIG. 1 wherein loudspeakers 17, 18 are replaced with loudspeakers 32, 33 spaced well apart and located in room 31 relative to listener 34. The signals associated with channels R0 and R90 which are amplified via amplifiers 15, 16 are applied to loudspeakers 32, 33 spaced an equal distance "a" from and directed towards listener 34. This arrangement is less acceptable than the arrangements shown in FIG. 1 and FIG. 2 because the sweet spot where harmonic distortion is reduced may be relatively small and loudspeakers 32, 33 should be set up to beam towards the sweet spot. Placement of room furniture and acoustics of room 31 may also interfere with an optimum reduction of harmonic distortion as experienced by listener 34.

Figure 4:
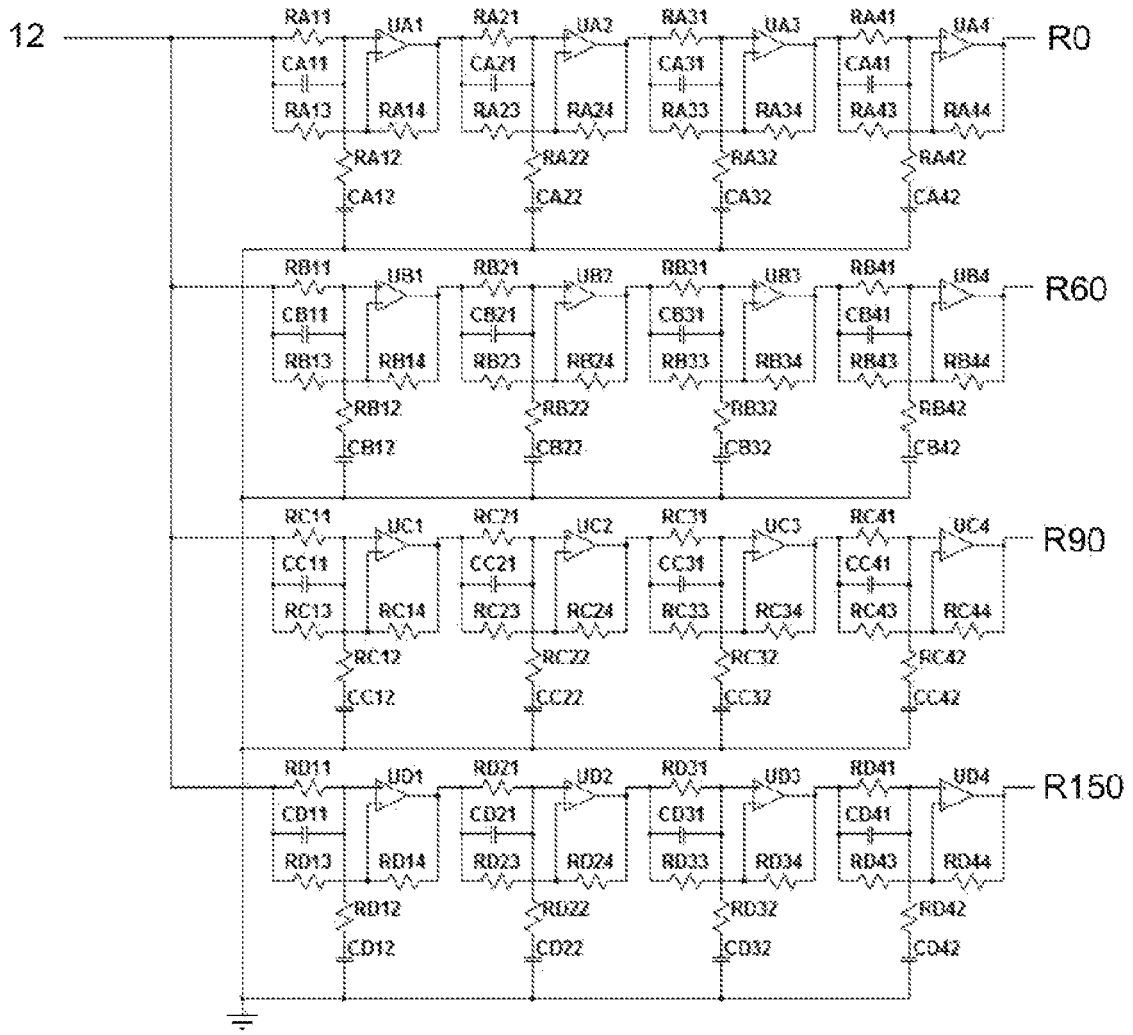
FIG. 4 shows a wide-band all-pass phase-difference circuit diagram suitable for four-channel distortion cancellation.

FIG. 4 shows an analog circuit for reproducing four separate channels R0, R60, R90 and R150 required to substantially cancel Second-order and Third-order harmonic distortion components and is directed to an entire audio spectrum. The four channels may be implemented digitally.

One possible set of derived values for components shown in FIG. 4 includes UC1 NE5514, RC11 50228, RC12 01332, RC13 10000, RC14 30531, CC11 224, CC12 224, UC2 NE5514, RC21 59350, RC22 01849, RC23 10000, RC24 30623, CC21 473, CC22 473, UC3 NE5514, RC31 81866, RC32 02469, RC33 10000, RC34 30603, CC31 103, CC32 103, UD1 NE5514, RD11 69227, RD12 02408, RD13 10000, RD14 40107, CD11 104, CD12 683, UD2 NE5514, RD21 85814, RD22 02631, RD23 10000, RD24 30613, CD21 223, CD22 223, UD3 NE5514, RD31 115631, RD32 03242, RD33 10000, RD34 30561, CD31 472, CD32 472, UC4 NE5514, RC41 110941, RC42 1588, RC43 10000, RC44 30286, CC41 222, CC42 222, UD4 NE5514, RD41 194934, RD42 01051, RD43 10000, RD44 39520, CD41 102, CD42 681, UA1 NE5514, RA11 79694, RA12 01141, RA13 10000, RA14 30286, CA11 474, CA12 474, UA2 NE5514, RA21 52992, RA22 01598, RA23 10000, RA24 30603, CA21 104, CA22 104, UA3 NE5514, RA31 68435, RA32 02132, RA33 10000, RA34 30623, CA31 223, CA32 223, UB1 NE5514, RB11 73104, RB12 01632, RB13 10000, RB14 30446, CB11 224, CB12 224, UB2 NE5514, RB21 72295, RB22 02262, RB23 10000, RB24 30626, CB21 473, CB22 473, UB3 NE5514, RB31 100641, RB32 03092, RB33 10000, RB34 30615, CB31 103, CB32 103, UA4 NE5514, RA41 94975, RA42 02519, RA43 10000, RA44 30531, CA41 472, CA42 472, UB4 NE5514, RB41 135433, RB42 02510, RB43 10000, RB44 30371, CB41 222, CB42 222. Resistor values are in ohms and leading zeros may be ignored. Capacitor values are in standard abbreviated notation, wherein, for example, 473 denotes 47,000 pico-farads or 47 nano-farads.

In a four-channel embodiment one alternative to using four separate circuits to create phase-difference channels may include using separate circuits for two channels with 90 degrees phase-difference outputs only and then generating each of the remaining two channels from a linear combination of outputs of these circuits. For example, if the channels sought are A (0 degrees), B (60 degrees), C (90 degrees) and D (150 degrees) respectively, and the gain constants for the linear combination from channels A and C are G and H respectively, trigonometry may be used to determine G and H such that exp (j.theta)=cos (theta)+j.sin (theta)=G+j.H, wherein theta is the required phase difference from the in-phase channel (reference Channel A), and j is the imaginary unit (square root of −1) representing the quadrature output (Channel C). Hence G=cos (theta) and H=sin (theta).

For Channel B, theta=pi/3 radians (60°), so G=cos 60°=0.500, and H=sin 60°=sqrt (3)/2=0.866. For Channel D, theta=5.pi/6 radians (150°), so G=cos 150°=−sqrt (3)/2=−0.866, and H=sin 150°=0.500. The scaled outputs may be summed to form outputs for Channels B and D.

The concept of harmonic cancellation described above pertains to a set of substantially-identical loudspeakers fed with substantially-identical signals except for a relative phase difference between the signals. Each individual loudspeaker may distort its radiated sound in a similar fashion and the distorted outputs may be brought together and summed before reaching the listener. For very low audio frequencies individual loudspeakers may be placed adjacent to each other to form a circular cluster, for example. For higher audio frequencies summing may be performed in a plenary chamber so that path length differences to a listener may not undo intended coherent addition of individual loudspeaker outputs.

Consider a single sinusoid as a signal source. Each individual loudspeaker may radiate a fundamental frequency as well as harmonic distortion components of the fundamental frequency, including Second-order and Third-order harmonic distortion components, due for example to nonlinearities in the loudspeakers. When there is no phase difference between signals applied to individual loudspeakers, fundamental output from each loudspeaker may sum coherently, and harmonic output (distortion) from each loudspeaker may also sum coherently. If there are two loudspeakers in a set, total sound pressure output (including distortion) will be double that from each loudspeaker radiating on its own (SPL is increased by 20 $\log_{10}(2)$=+6.021 dB). For three loudspeakers the increase will be +9.542 dB, for four loudspeakers the increase will be +12.041 dB, and so on. The above calculations ignore the effect of mutual acoustical coupling between individual loudspeakers.

Consider now the case of two identical loudspeakers A, B fed with a single sinusoid of angular frequency ω rad/s but with a phase difference of ϕ degrees. The sound pressure output from loudspeaker A may be expressed as $$p_A(t)=A_1 \sin\{(\omega t+\phi_A)+\theta_1\}+A_2 \sin\{2(\omega t+\phi_A)+\theta_2\}+A_3 \sin\{3(\omega t+\phi_A)+\theta_3\}+\ldots \quad (1)$$

while the sound pressure output from loudspeaker B may be similarly expressed as $$\begin{aligned} p_B(t) &= A_1\sin\{(\omega t+\phi_B)+\theta_1\}+A_2\sin\{2(\omega t+\phi_B)+\theta_2\}+ \\ &\quad A_3\sin\{3(\omega t+\phi_B)+\theta_3\}+\ldots \\ &= A_1\sin\{(\omega t+\phi_A+\phi)+\theta_1\}+A_2\sin\{2(\omega t+\phi_A+\phi)+\theta_2\}+ \\ &\quad A_3\sin\{3(\omega t+\phi_A+\phi)+\theta_3\}+\ldots \end{aligned} \quad (2)$$

wherein $\phi_B-\phi_A=\phi$.

Here $\theta_1$ is the phase shift of the fundamental output caused by the driver and its enclosure at the fundamental angular frequency ω, $\theta_2$ is the phase angle of the second-harmonic distortion output as modified by the driver and its enclosure at the second-harmonic angular frequency 2ω, $\theta_3$ is the phase angle of the third-harmonic distortion output as modified by the driver and its enclosure at the third-harmonic angular frequency 3ω, and so on.

By using the trigonometric identity $$\sin(\alpha+\beta)=\sin\alpha\cdot\cos\beta+\cos\alpha\cdot\sin\beta \quad (3)$$

the total sound pressure output from the two loudspeakers will be $$p(t)=p_A(t)+p_B(t)=A_1[\sin\{(\omega t+\phi_A)+\theta_1\}\cdot[1+\cos\phi]+\cos\{(\omega t+\phi_A)+\theta_1\}\cdot\sin\phi]+A_2[\sin\{2(\omega t+\theta_A)+\theta_2\}\cdot[1+\cos 2\phi]+\cos\{2(\omega t+\phi_A)+\theta_2\}\cdot\sin 2\phi]+A_3[\sin\{(\omega t+\theta_A)+\theta_3\}\cdot[1+\cos 3\phi]+\cos\{3(\omega t+\phi_A)+\theta_3\}\cdot\sin 3\phi]+\ldots \quad (4)$$

The peak magnitude of the fundamental output has been increased from $A_1$ for a single loudspeaker to $$|p_1|=A_1\sqrt{[1+\cos\phi]^2+[\sin\phi]^2} \quad (5)$$

for both loudspeakers, while the second-harmonic distortion output has been modified from peak magnitude $A_2$ to $$|p_2|=A_2\sqrt{[1+\cos 2\phi]^2+[\sin 2\phi]^2} \quad (6)$$

for both loudspeakers, and the third-harmonic distortion output has been modified from peak magnitude $A_3$ to $$|p_3|=A_3\sqrt{[1+\cos 3\phi]^2+[\sin 3\phi]^2} \quad (7)$$

for both loudspeakers, and so on.

The resultant fundamental output from the two loudspeakers can be written as $$\begin{aligned} p_1(t) &= A_1[\sin\{(\omega t+\phi_A)+\theta_1\}\cdot[1+\cos\phi]+\cos\{(\omega t+\phi_A)+\theta_1\}\cdot\sin\phi] \\ &= A_R[\sin\{(\omega t+\phi_A+\phi_R)+\theta_1\}] \\ &= A_R[\sin\{(\omega t+\phi_A)+\theta_1\}\cdot\cos\phi_R+\cos\{(\omega t+\phi_A)+\theta_1\}\cdot\sin\phi_R] \end{aligned} \quad (8)$$

wherein $$A_R = A_1\sqrt{[1+\cos\phi]^2+[\sin\phi]^2} \quad (9)$$

$$\tan\phi_R = \frac{\sin\phi}{1+\cos\phi} = \tan\frac{\phi}{2} \text{ so that } \phi_R = \frac{\phi}{2}$$

Hence the phase shift of the resultant fundamental output is $$\frac{\phi}{2}$$

relative to the output from loudspeaker A. In other words, the phase angle of the resultant fundamental output is the average of the phase angles of the fundamental output from the two identical loudspeakers.

When the phase difference ϕ is zero, so that the two identical loudspeakers are fed with identical sinusoids, $|p_1|$, $|p_2|$ and $|p_3|$ become $2A_1$, $2A_2$ and $2A_3$, as expected. The peak magnitude of the fundamental and each harmonic is doubled, so there is no change in the percentage of harmonic distortion.

However, two important cases emerge when the phase difference ϕ is not zero. The first case involves cancellation of the second harmonic component.

If the phase difference ϕ is chosen equal to 90° then $|p_1|$, $|p_2|$ and $|p_3|$ become $A_1\sqrt{2}$, 0 and $A_3\sqrt{2}$. The second-harmonic distortion output is precisely cancelled while the fundamental and third-harmonic outputs are both reduced by a factor of $\sqrt{2}$(3.0103 dB) compared to the case of zero phase difference between the applied sinusoids. The relative third-harmonic distortion is unchanged but the second-harmonic distortion vanishes.

The analysis may be extended to show that some higher-order harmonic distortion components are also cancelled, but sometimes enhanced, as indicated in the table below. The table shows two identical loudspeakers fed with sinusoids with relative phase angles of 0° and 90°. FR=Resultant of Fundamental, 2R=Resultant of 2nd harmonic, 3R=Resultant of 3rd harmonic, etc.

| | FR | 2R | 3R | 4R | 5R | 6R | 7R | 8R | 9R | 10R | 11R |
|---|---|---|---|---|---|---|---|---|---|---|---|
| Degrees | 45 | | −45 | | 45 | | −45 | | 45 | | −45 |
| Magnitude | 1.414 | 0 | 1.414 | 2.0 | 1.414 | 0 | 1.414 | 2.0 | 1.414 | 0 | 1.414 |
| dB wrt fundamental | (3.01) | —∞ | 0 | 3.01 | 0 | —∞ | 0 | 3.01 | 0 | —∞ | 0 |

Figure 5:
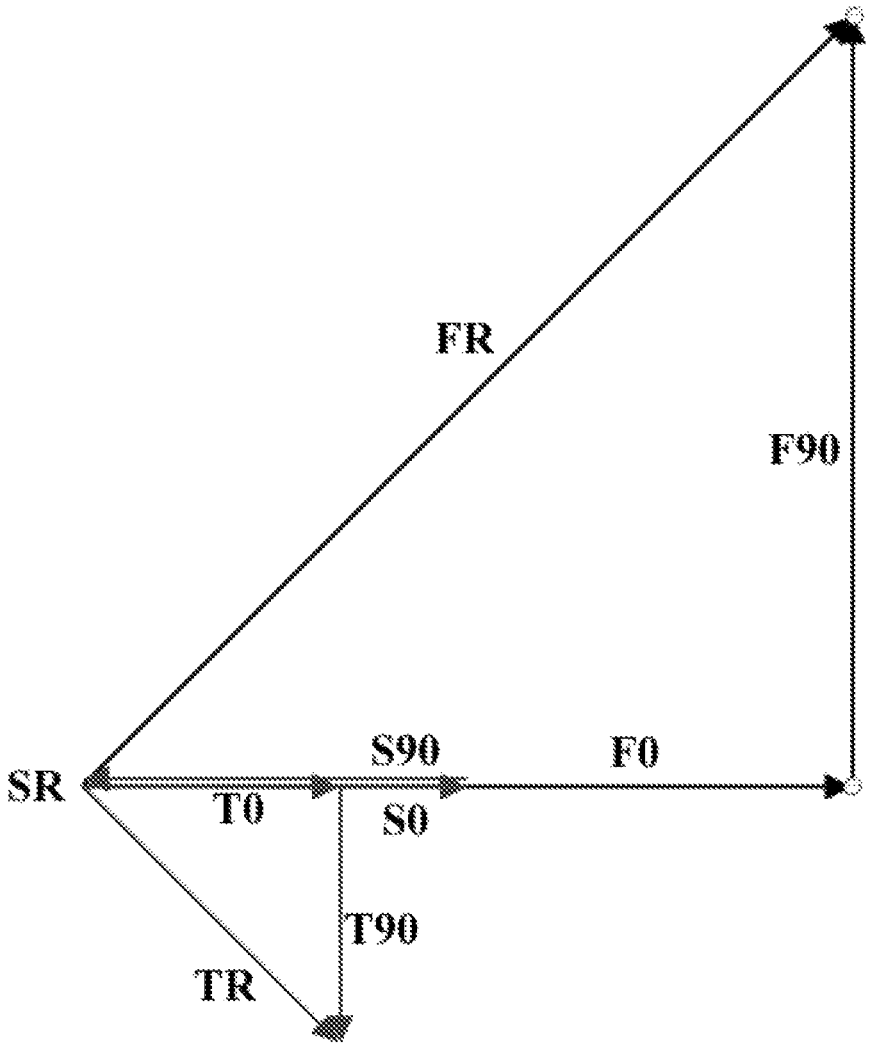
FIG. 5 shows a phasor diagram for summing outputs from two identical loudspeakers fed with sinusoids with relative phase angles of zero degrees and ninety degrees.

The analysis can also be visualised in a phasor diagram as shown in FIG. 5. The phasors of the fundamentals of both the reference signal and the 90 degree phase-separated signal are designated F. The phasors of the Second-order harmonic components are designated S and the phasors of the Third-order harmonic components are designated T. The phasors relating to the reference signal are suffixed 0 and the phasors relating to the 90 degree phase-separated signal are suffixed 90. The resultant phasors are suffixed R. Accordingly, F0 denotes Fundamental of reference signal. F90 denotes Fundamental of 90 degree phase-separated signal. FR denotes Resultant of Fundamentals. S0 denotes Second-order harmonic component of reference signal. S90 denotes Second-order harmonic component of 90 degree phase-separated signal. The resultant of Second-order harmonic components denoted by SR cannot be seen because it is zero (a point on the phasor diagram). T0 denotes Third-order harmonic component of reference signal. T90 denotes Third-order harmonic component of 90 degree phase-separated signal. TR denotes Resultant of Third-order harmonic components.

The second case involves cancellation of the third harmonic component. If the phase difference $\phi$ is chosen equal to 60° then $|p_2|$ and $|p_3|$ become $A_1\sqrt{3}$, $A_2$ and 0. The third-harmonic distortion output is precisely cancelled while the fundamental output is reduced by a factor of $2/\sqrt{3}\approx 1.1547$ (1.2494 dB) and the second-harmonic output is reduced by a factor of 2 (6.0206 dB) compared to the case of zero phase difference between the applied sinusoids. The relative second-harmonic distortion is reduced by 4.7712 dB but the third-harmonic distortion vanishes.

The analysis may be extended to show that some higher-order harmonic distortion components are also cancelled, but sometimes enhanced, as indicated in the table below. The table shows two identical loudspeakers fed with sinusoids with relative phase angles of 0° and 60°. FR=Resultant of Fundamental, 2R=Resultant of 2nd harmonic, 3R=Resultant of 3rd harmonic, etc.

| | FR | 2R | 3R | 4R | 5R | 6R | 7R | 8R | 9R | 10R | 11R |
|---|---|---|---|---|---|---|---|---|---|---|---|
| Degrees | 30 | 60 | | −60 | −30 | 0 | 30 | 60 | | −60 | −30 |
| Magnitude | 1.732 | 1.0 | 0 | 1.0 | 1.732 | 2.0 | 1.732 | 1.0 | 0 | 1.0 | 1.732 |
| dB wrt fundamental | (4.77) | −4.77 | —∞ | −4.77 | 0 | 1.249 | 0 | −4.77 | —∞ | −4.77 | 0 |

Figure 6:
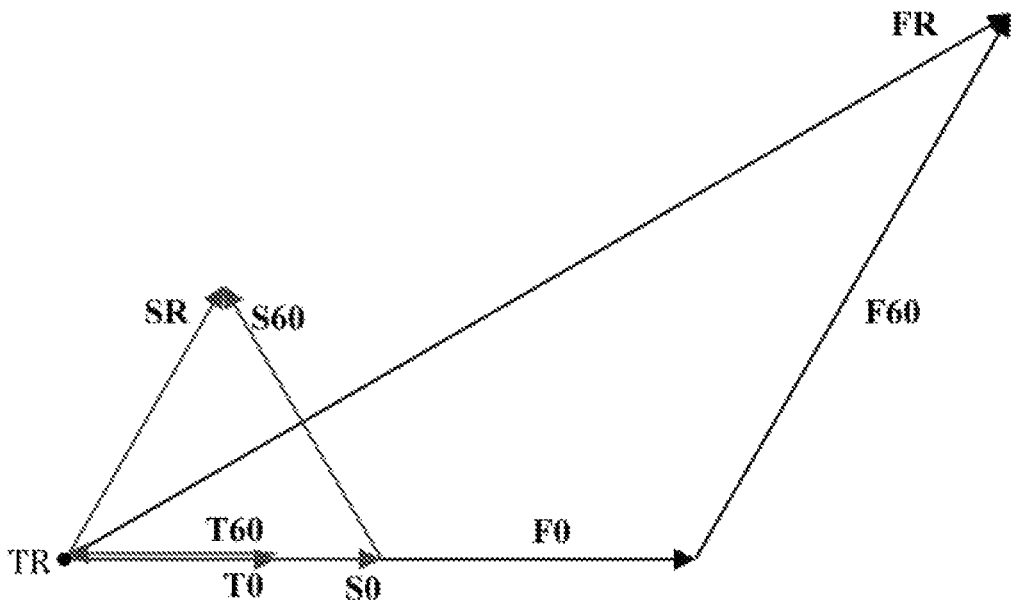
FIG. 6 shows a phasor diagram for summing outputs from two identical loudspeakers fed with sinusoids with relative phase angles of zero degrees and sixty degrees.

The analysis can also be visualised in a phasor diagram as shown in FIG. 6. The phasors of the fundamentals of both the reference signal and the 60 degree phase-separated signal are designated F. The phasors of the Second-order harmonic components are designated S and the phasors of the Third-order harmonic components are designated T. The phasors relating to the reference signal are suffixed 0 and the phasors relating to the 60 degree phase-separated signal are suffixed 60. The resultant phasors are suffixed R. Accordingly, F0 denotes Fundamental of reference signal. F60 denotes Fundamental of 60 degree phase-separated signal. FR denotes Resultant of Fundamentals. S0 denotes Second-order harmonic component of reference signal. S60 denotes Second-order harmonic component of 60 degree phase-separated signal. SR denotes Resultant of Second-order harmonic components. T0 denotes Third-order harmonic component of reference signal. T60 denotes Third-order harmonic component of 60 degree phase-separated signal. The resultant of Third-order harmonic components denoted by TR cannot be seen because it is zero (a point on the phasor diagram).

The challenge now is cancellation of both Second-order and Third-order harmonic distortion components. It may be shown that there is no phase difference $\phi$ between the sinusoids applied to two identical loudspeakers that will cause both the Second-order and the Third-order harmonic distortion outputs to cancel simultaneously (without also cancelling the fundamental output).

However, simultaneous cancellation may be possible with four identical loudspeakers A, B, C, D. The idea may be to start with a pair of loudspeakers having cancelled Third-order harmonic distortion components. If the relative phase angles of the loudspeakers in the pair are 0° and 60°, their resultant fundamental output may have a relative phase angle of 30°. A second pair of loudspeakers having cancelled third-harmonic distortion may then be added to the first pair. If the resultant fundamental output from the second pair has a relative phase angle of 120°(that is, 90° displaced from the first pair), the resultant second-harmonic distortion from the four loudspeakers may be cancelled, while the resultant third-harmonic distortion may remain cancelled. The relative phase angle of the loudspeakers in the second pair must therefore be 90° and 150°. The four loudspeakers A, B, C, D will then have relative phase angles of 0°, 60°, 90° and 150°, respectively.

For these phase differences the peak magnitude of the resultant fundamental output from the four identical loudspeakers is $$
\begin{aligned}
|p_1| &= A_1\sqrt{[\cos\phi_A+\cos\phi_B+\cos\phi_C+\cos\phi_D]^2+[\sin\phi_A+\sin\phi_B+\sin\phi_C+\sin\phi_D]^2} \\
&= A_1\sqrt{[\cos 0^\circ+\cos 60^\circ+\cos 90^\circ+\cos 150^\circ]^2+[\sin 0^\circ+\sin 60^\circ+\sin 90^\circ+\sin 150^\circ]^2} \\
&= A_1\sqrt{\left[1+\frac{1}{2}+0-\frac{\sqrt{3}}{2}\right]^2+\left[0+\frac{\sqrt{3}}{2}+1+\frac{1}{2}\right]^2} \\
&= A_1\sqrt{6}
\end{aligned}
\tag{10}
$$

When the phase differences are zero, so that four identical loudspeakers are fed with identical sinusoids, $|p_1|$ becomes $4A_1$, as expected, which is a factor of $4/\sqrt{6}$or $\sqrt{18/3}$(4.2597 dB) greater than $\sqrt{6}A_1$. That reduction in the resultant fundamental output is the penalty to be paid for achieving cancellation of second-harmonic and third-harmonic distortion. The nominal input power to the loudspeakers would need to increase by the ratio 8:3 in order to recover the reduction in fundamental output.

The analysis may be extended to show that some higher-order harmonic distortion components are also cancelled, as indicated in the table below. The table shows four identical loudspeakers fed with sinusoids with relative phase angles of 0°, 60°, 90° and 150°. FR=Resultant of Fundamental, 2R=Resultant of 2nd harmonic, 3R=Resultant of 3rd harmonic, etc.

| | FR | 2R | 3R | 4R | 5R | 6R | 7R | 8R | 9R | 10R | 11R |
|---|---|---|---|---|---|---|---|---|---|---|---|
| Degrees | 75 | | | −60 | 15 | | −15 | 60 | | | −75 |
| Magnitude | 2.449 | 0 | 0 | 2.0 | 2.449 | 0 | 2.449 | 2.0 | 0 | 0 | 2.449 |
| dB wrt fundamental | (7.78) | —∞ | —∞ | −1.76 | 0 | —∞ | 0 | −1.76 | —∞ | —∞ | 0 |

Figure 7:
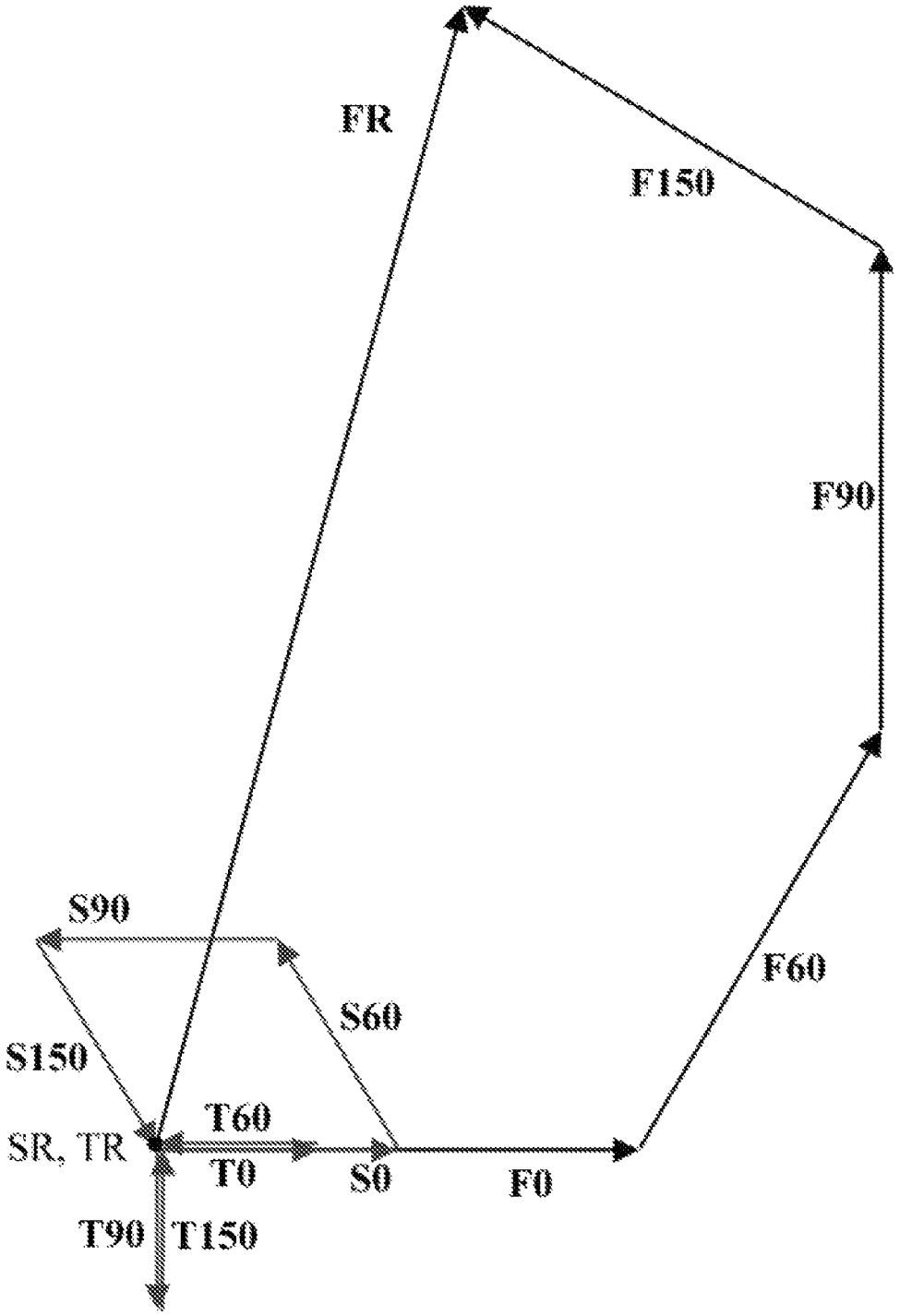
FIG. 7 shows a phasor diagram for summing outputs from four identical loudspeakers fed with sinusoids with relative phase angles of zero degrees, sixty degrees, ninety degrees and one hundred and fifty degrees.

The analysis may also be visualised in a phasor diagram as shown in FIG. 7. The phasors of the fundamentals of the reference signal, the 60 degree phase-separated signal, the 90 degree phase-separated signal and the 150 degree phase-separated signal are designated F. The phasors of the Second-order harmonic components are designated S and the phasors of the Third-order harmonic components are designated T. The phasors relating to the reference signal are suffixed 0 and the phasors relating to the 60 degree phase-separated signal are suffixed 60. The phasors relating to the 90 degree phase-separated signal are suffixed 90. The phasors relating to the 150 degree phase-separated signal are suffixed 150. The resultant phasors are suffixed R. Accordingly, F0 denotes Fundamental of reference signal. F60 denotes Fundamental of 60 degree phase-separated signal. F90 denotes Fundamental of 90 degree phase-separated signal. F150 denotes Fundamental of 150 degree phase-separated signal. FR denotes Resultant of Fundamentals. S0 denotes Second-order harmonic component of reference signal. S60 denotes Second-order harmonic component of 60 degree phase-separated signal. S90 denotes Second-order harmonic component of 90 degree phase-separated signal. S50 denotes Second-order harmonic component of 150 degree phase-separated signal. The resultant of Second-order harmonic components denoted by SR cannot be seen because it is zero (a point on the phasor diagram). T0 denotes Third-order harmonic component of reference signal. T60 denotes Third-order harmonic component of 60 degree phase-separated signal. T90 denotes Third-order harmonic component of 90 degree phase-separated signal. T150 denotes Third-order harmonic component of 150 degree phase-separated signal. The resultant of Third-order harmonic components denoted by TR cannot be seen because it is zero (a point on the phasor diagram).

Returning to the case of two identical loudspeakers A, B, consider the signal to include the sum of two sinusoids of angular frequencies $\omega_\alpha$ and $\omega_\beta$ rad/s. The two loudspeakers may be fed with the same signal but with a phase difference of $\phi$ degrees (constant with frequency). The sound pressure output from loudspeaker A may be expressed as $$
\begin{aligned}
p_A(t)=&A_{1\alpha}\sin\{(\omega_\alpha t+\phi_{\alpha A})+\theta_{1\alpha}\}+A_{1\beta}\sin\{(\omega_\beta t+\phi_{\beta A})+\\
&\theta 1\beta\}+A_{2\alpha}\sin\{2(\omega_\alpha t+\phi_{\alpha A})+\theta_{2\alpha}\}+A_{2\beta}\sin\\
&\{2(\omega_\beta t+\phi_{\beta A})+\theta_{2\beta}\}+A_{3\alpha}\sin\{3(\omega_\alpha t+\phi_{\alpha A})+\theta_{3\alpha}\}+\\
&A_{3\beta}\sin\{3(\omega_\beta t+\phi_{\beta A})+\theta_{3\beta}\}+A_{\alpha-\beta}\sin\{(\omega_\alpha t+\phi_{\alpha A})-\\
&(\omega_\beta t+\phi_{\beta A})+\theta_{\alpha-\beta}\}+A_{\alpha+\beta}\sin\{(\omega_\alpha t+\theta_{\alpha A})+(\omega_\beta t+\\
&\phi_{\beta A})+\theta_{\alpha+\beta}\}+A_{2\alpha-\beta}\sin\{2(\omega_\alpha t+\phi_{\alpha A})-(\omega_\beta t+\phi_{\beta A})+\\
&\theta_{2\alpha-\beta}\}+A_{2\alpha+\beta}\alpha\sin\{2(\omega_\alpha t+\phi_{\alpha A})+(\omega_\beta t+\phi_{\beta A})+\\
&\theta_{2\alpha+\beta}\}+A_{\alpha-2\beta}\sin\{(\omega_\alpha t+\phi_{\alpha A})-2(\omega_\beta t+\phi_{\beta A})+\\
&\theta_{\alpha-2\beta}\}+A_{\alpha+2\beta}\sin\{(\omega_\alpha t+\phi_{\alpha A})+2(\omega_\beta t+\phi_{\beta A})+\\
&\theta_{\alpha+2\beta}\}+\ldots
\end{aligned}
\tag{11}
$$

The sound pressure output from loudspeaker B may be similarly expressed but with $\phi_{\alpha B}$ replacing $\phi_{\alpha A}$ and $\phi_{\beta B}$ replacing $\phi_{\beta A}$ wherein $\phi_{\beta B}-\phi_{\alpha A}=\phi_{\beta B}-\phi_{\beta A}=\phi$. The total sound pressure output from the two loudspeakers may contain the fundamental angular frequencies, $\omega_\alpha$ and $\omega_\beta$ rad/s, together with extra frequencies due to the non-linearity, namely, the second-harmonic frequencies, $2\omega_\alpha$ and $2\omega_\beta$, and the third-harmonic frequencies, $3\omega_\alpha$ and $3\omega_\beta$, etc., the Second-order intermodulation frequencies, $|\omega_\alpha-\omega_\beta|$ and $\omega_\alpha+\omega_\beta$, the Third-order intermodulation frequencies, $|2\omega_\alpha-\omega_\beta|$, $2\omega_\alpha+\omega_\beta|$, $|\omega_\alpha-2\omega_\beta|$ and $\omega_\alpha+2\omega_\beta$, and so on.

The analysis shows that when second-harmonic distortion is cancelled, the Second-order intermodulation sum frequency $\omega_\alpha+\omega_\beta$ is also cancelled, but not the difference frequency $|\omega_\alpha-\omega_\beta|$. The analysis also shows that when third-harmonic distortion is cancelled, the Third-order intermodulation sum frequencies, $2\omega_\alpha+\omega_\beta$ and $\omega_\alpha+2\omega_\beta$, are also cancelled, but not the difference frequencies, $|2\omega_\alpha-\omega_\beta|$ and $|\omega_\alpha-2\omega_\beta|$.

The following table identifies phase differences for complete cancellation of Second-order and Third-order harmonic distortion components in arrangements of two, three and four loudspeakers. It also shows examples of phase differences to achieve equal cancellation of Second-order and Third-order harmonic distortion components in arrangements of two and three loudspeakers. The table may provide a guide for a designer to choose phase differences that are appropriate for a particular design. For example, if a particular design has Second-order harmonic distortion components on average 10% higher than Third-order harmonic distortion components, the designer may choose an arrangement of two loudspeakers with a phase difference of 74 degrees by extrapolation from the table.

| Number of loudspeakers | Designations of loudspeakers | Phase differences of loudspeakers relative to Loudspeaker A (degrees) | Percentage reduction of second-harmonic distortion | Percentage reduction of third-harmonic distortion |
|---|---|---|---|---|
| 2 | A, B | 90 | 100 | 0 |
| 2 | A, B | 270 | 100 | 0 |
| 2 | A, B | 60 | 42 | 100 |
| 2 | A, B | 300 | 42 | 100 |
| 2 | A, B | 72 | 62 | 62 |
| 2 | A, B | 288 | 62 | 62 |
| 3 | A, B, C | 60, 120 | 100 | 50 |
| 3 | A, B, C | 240, 300 | 100 | 50 |
| 3 | A, B, C | 60, 300 | 100 | 50 |
| 4 | A, B, C, D | 60, 90, 150 | 100 | 100 |
| 4 | A, B, C, D | 210, 270, 300 | 100 | 100 |
| 4 | A, B, C, D | 30, 90, 300 | 100 | 100 |
| 4 | A, B, C, D | 60, 270, 330 | 100 | 100 |

Figure 8:
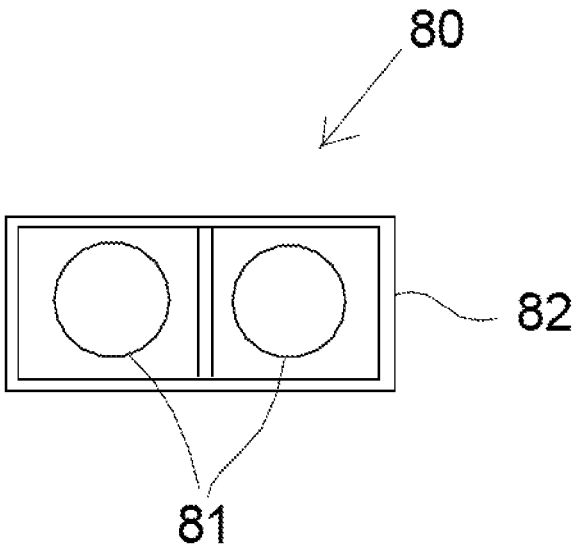
FIG. 8 shows one embodiment of a loudspeaker suitable for managing and/or reducing harmonic distortion.

FIG. 8 shows one example of loudspeaker 80 suitable for use with apparatus for managing and/or reducing harmonic distortion as described herein. Loudspeaker 80 comprises two loudspeaker drivers 81 having substantially-equal performance parameters housed in a single enclosure 82, wherein drivers 81 are housed in separate substantially-identical compartments of enclosure 82 such that Second-order harmonic distortion components arising from non-linearities of drivers 81 may be substantially cancelled when signals reproduced by drivers 81 have a phase difference of ninety degrees.

Figure 9:
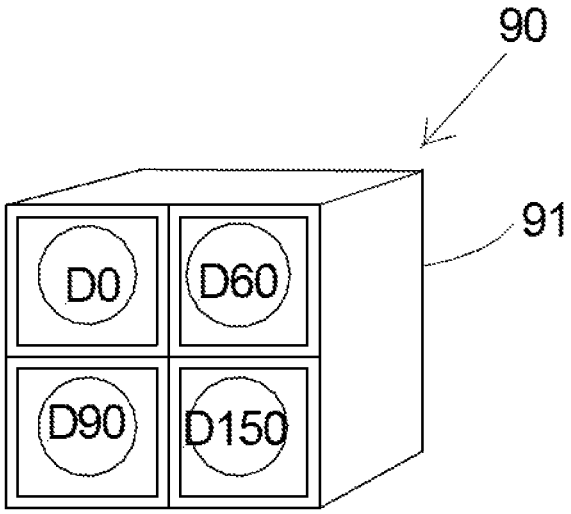
FIG. 9 shows another embodiment of a loudspeaker suitable for managing and/or reducing harmonic distortion.

FIG. 9 shows another example of loudspeaker 90 suitable for use with apparatus for managing and/or reducing harmonic distortion as described herein. Loudspeaker 90 comprises four loudspeaker drivers D0, D60, D90 and D150, having substantially-equal performance parameters housed in a single enclosure 91. Drivers D60, D90 and D150 are adapted to be driven via signals shifted in phase by 60, 90 and 150 degrees respectively relative to the reference audio signal driving reference driver D0. Drivers D0, D60, D90 and D150 are housed in separate substantially-identical compartments of enclosure 91. Driver D0 is housed diametrically opposite driver D150. If used in a stereo system driver D0 may be placed towards the centre-line of a stereo pair and driver D150 may be placed away from the centre-line of the stereo pair.

A loudspeaker with an arrangement of drivers as shown in FIG. 9 may comprise a right loudspeaker of a stereo pair and the left loudspeaker may comprise a mirror image arrangement of drivers. As a general rule, the closer that drivers are placed to each other, the better their output radiation should mix and the wider the sweet spot of substantially cancelled second-harmonic and third-harmonic distortion components should be when signals reproduced by drivers D60, D90 and D150 have 60, 90 and 150 degree phase differences relative to the reference audio signal reproduced by driver D0.

Figure 10:
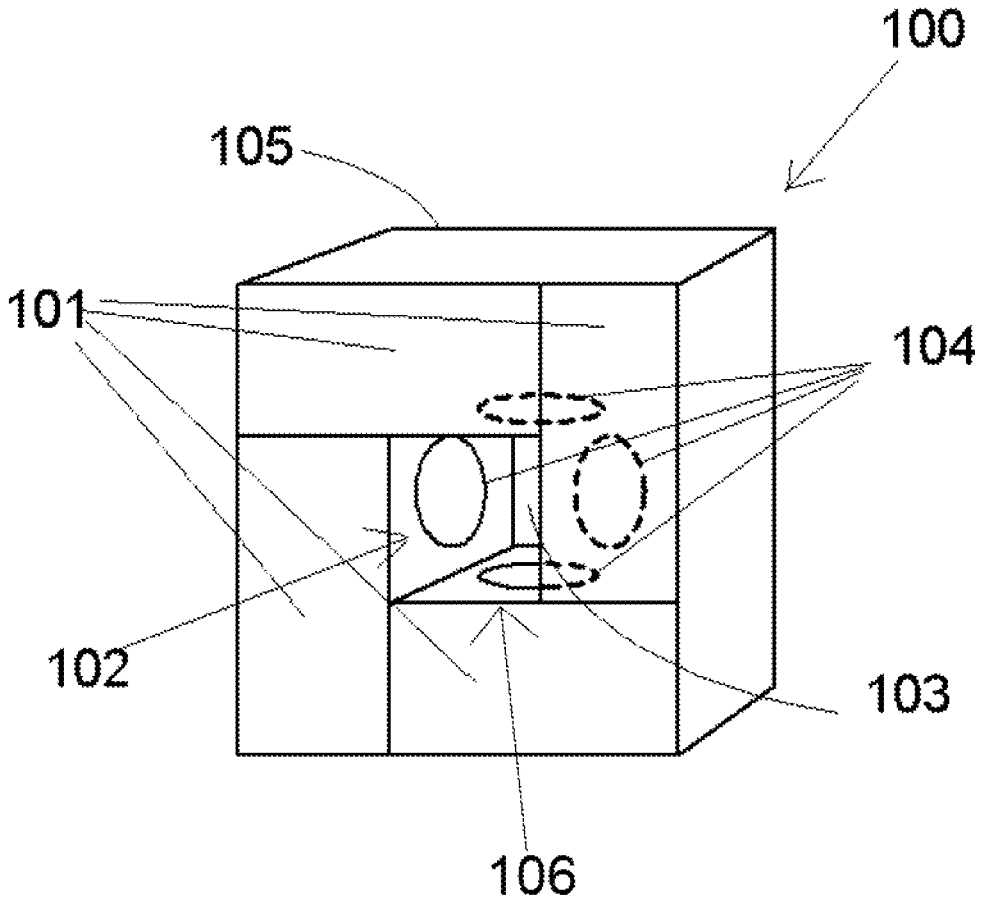
FIG. 10 shows a further embodiment of a loudspeaker suitable for managing and/or reducing harmonic distortion.

FIG. 10 shows another embodiment of loudspeaker 100 suitable for use with apparatus for managing and/or reducing harmonic distortion as described herein. Loudspeaker 100 comprises four loudspeaker drivers 104 having substantially-equal performance parameters housed in separate substantially-identical compartments 101 of enclosure 105. Drivers 104 face each other across a cavity or plenum 102 which may be enclosed at the back by baffle 103. In this configuration three drivers 104 are adapted to be driven via signals shifted in phase by 60, 90 and 150 degrees respectively relative to the reference audio signal which drives the fourth driver 104. The reference audio signal and the signal shifted in phase by 150 degrees may drive oppositely facing drivers.

For optimum performance the width, height and depth of cavity 102 should be as small as practicable to comfortably house drivers 104 while leaving an aperture 106 at the front that is less in width or height than 150% of the diameter of each driver 104. This embodiment has an advantage in that it may potentially cancel harmonic distortion components at all angles of radiation. Assuming that drivers 104 are operated below piston range, the radiation pattern of loudspeaker 100 may be substantially omni-directional into half-space (27 steradians).

Finally, it is to be understood that various alterations, modifications and/or additions may be introduced into the constructions and arrangements of parts previously described without departing from the spirit or ambit of the invention.

The invention claimed is:

1. Apparatus for managing and/or reducing harmonic distortion components arising along a signal path associated with an audio signal or audio system, said apparatus comprising:

a phase generator for generating at least one phase-difference signal being a version of said audio signal that has a constant difference in phase relative to said audio signal acting as a reference audio signal, or a reference audio signal generated by said phase generator, wherein the or each constant phase difference is adapted to provide cancellation of said harmonic distortion components arising along said signal path;

respective amplifier channels for receiving and separately amplifying said audio signal acting as a reference audio signal, or said reference audio signal generated by said phase generator, and the or each version of said audio signal, wherein each amplifier channel has substantially-equal gain and/or performance parameters; and respective loudspeaker channels for receiving and separately producing sound corresponding to the amplified audio signal acting as a reference audio signal, or reference audio signal generated by said phase generator, and the or each amplified version of said audio signal, wherein each loudspeaker channel has substantially-equal performance parameters and is adapted to radiate said sound relative to other loudspeaker channels to produce a combined sound that corresponds to said audio signal with harmonic distortion components that are reduced compared to said harmonic distortion components arising along said signal path.

2. Apparatus according to claim 1 wherein said reference audio signal includes a version of said audio signal whose frequency components have a reference phase.

3. Apparatus according to claim 2 wherein the phase difference is adapted to switch from 90 degrees at a relatively low power level to 60 degrees at a relatively high power level, wherein switching the phase difference from 90 degrees to 60 degrees is configured to occur at a power level chosen such that the switching results in an overall reduction of dominant Second-order harmonic distortion components and dominant Third-order harmonic distortion components.

4. Apparatus according to claim 2 wherein the phase difference transitions gradually from 90 degrees to 60 degrees as power level increases.

5. Apparatus according to claim 2 wherein the phase difference transitions gradually from 90 degrees to 60 degrees as a non-constant function of the frequencies present in the audio signal.

6. Apparatus according to claim 1 wherein said phase generator is adapted to generate one version of said audio signal that is shifted in phase by 90 degrees relative to said audio signal acting as a reference audio signal, or said reference audio signal generated by said phase generator, to provide cancellation of Second-order harmonic distortion components using two channels.

7. Apparatus according to claim 1 wherein said phase generator is adapted to generate one version of said audio signal that is shifted in phase by a first angle relative to said audio signal acting as a reference audio signal, or said reference audio signal generated by said phase generator, to provide at least partial cancellation of both Second-order and Third-order harmonic distortion components using two channels.

8. Apparatus according to claim 1 wherein said phase generator is adapted to generate two versions of said audio signal that are shifted in phase by 60 degrees and 120 degrees respectively relative to said audio signal acting as a reference audio signal, or said reference audio signal generated by said phase generator, to provide cancellation of Second-order harmonic distortion components and at least partial cancellation of Third-order harmonic distortion components using three channels.

9. Apparatus according to claim 1 wherein said phase generator is adapted to generate two versions of said audio signal that are shifted in phase by first and second angles relative to said audio signal acting as a reference audio signal, or said reference audio signal generated by said phase generator, to provide partial cancellation of both Second-order and Third-order harmonic distortion components using three channels.

10. Apparatus according to claim 1 wherein said phase generator is adapted to generate three versions of said audio signal that are shifted in phase by 60 degrees, 90 degrees and 150 degrees respectively relative to said audio signal acting as a reference audio signal, or said reference audio signal generated by said phase generator, to provide cancellation of both Second-order and Third-order harmonic distortion components using four channels.

11. Apparatus according to claim 1 wherein said phase generator is adapted to generate three versions of said audio signal that are shifted in phase by first, second and third angles relative to said audio signal acting as a reference audio signal, or said reference audio signal generated by said phase generator, to provide cancellation of two orders of harmonic distortion components using four channels.

12. Apparatus according to claim 1 wherein each loudspeaker channel includes a direct radiator and is oriented towards an audience.

13. Apparatus according to claim 1 wherein the loudspeaker channels are oriented towards each other.

14. Apparatus according to claim 1 wherein each loudspeaker channel radiates from a port and the ports are located adjacent to each other.

15. Apparatus according to claim 1 wherein said phase generator includes an analog circuit.

16. Apparatus according to claim 1 wherein said phase generator includes a digital signal processor (DSP).

17. Apparatus according to claim 1 wherein each amplifier channel drives multiple loudspeaker drivers in arrays of multiple sets of loudspeakers.

18. Apparatus according to claim 17 wherein each loudspeaker channel includes a line array and wherein each alternate loudspeaker channel has its output shifted in phase by a different angle from a preceding one.

19. Apparatus according to claim 18 wherein said different angle is 90 degrees.

20. Apparatus according to claim 1 wherein each loudspeaker channel includes a closed box construction.

21. Apparatus according to claim 20 wherein each loudspeaker channel operates over a frequency band that includes a rising acoustic frequency response which is actively equalized.

22. Apparatus according to claim 1 wherein each loudspeaker channel includes technology of any known type including electromagnetic, magnetostatic, electrostatic, piezoelectric, electrostrictive, magnetostrictive, infinite baffle, closed box, vented box, passive-radiator box, dipolar and bipolar to produce subsonic, audible or ultrasonic sound in any gaseous, fluid or solid media.

23. A method for managing and/or reducing harmonic distortion components arising along a signal path associated with an audio signal or audio system, said method comprising:

generating at least one phase-difference signal being a version of said audio signal that has a constant difference in phase relative to said audio signal acting as a reference audio signal, or a reference audio signal generated by said phase generator, wherein the or each constant phase difference is adapted to provide cancellation of said harmonic distortion components arising along said signal path;

separately amplifying said audio signal acting as a reference audio signal, or said reference audio signal generated by said phase generator, and the or each version of said audio signal via respective amplifier channels, wherein each amplifier channel has substantially-equal gain and/or performance parameters; and separately producing sound corresponding to the amplified audio signal acting as a reference audio signal, or reference audio signal generated by said phase generator, and the or each amplified version of said audio signal via respective loudspeaker channels, wherein each loudspeaker channel has substantially-equal performance parameters and radiates said sound relative to other loudspeaker channels to produce a combined sound that corresponds to said audio signal with harmonic distortion components that are reduced compared to said harmonic distortion components arising along said signal path.

24. Apparatus for processing a signal such as an audio signal that is subject to harmonic distortion components arising along a signal path associated with a system such as an audio system, said apparatus comprising:

a phase generator for generating at least one phase-difference signal being a version of said audio signal that has a constant difference in phase relative to said audio signal acting as a reference audio signal, or a reference audio signal generated by said phase generator, wherein the or each constant phase difference is adapted to provide cancellation of said harmonic distortion components arising along said signal path; and wherein said reference audio signal and each version of said audio signal are adapted to produce a combined sound that corresponds to said audio signal with harmonic distortion components that are reduced compared to said harmonic distortion components arising along said signal path.

25. A method according to claim 24 wherein said reference audio signal includes a version of said audio signal whose frequency components have a reference phase.

26. Apparatus according to claim 24 wherein said phase generator is adapted to generate one version of said audio signal that is shifted in phase by 90 degrees relative to said audio signal acting as a reference audio signal, or said reference audio signal generated by said phase generator, to provide cancellation of Second-order harmonic distortion components using two channels.

27. Apparatus according to claim 24 wherein said phase generator is adapted to generate one version of said audio signal that is shifted in phase by a first angle relative to said audio signal acting as a reference audio signal, or said reference audio signal generated by said phase generator, to provide at least partial cancellation of both Second-order and Third-order harmonic distortion components using two channels.

28. Apparatus according to claim 24 wherein said phase generator is adapted to generate two versions of said audio signal that are shifted in phase by 60 degrees and 120 degrees respectively relative to said audio signal acting as a reference audio signal, or said reference audio signal generated by said phase generator, to provide cancellation of Second-order harmonic distortion components and at least partial cancellation of Third-order harmonic distortion components using three channels.

29. Apparatus according to claim 24 wherein said phase generator is adapted to generate two versions of said audio signal that are shifted in phase by first and second angles relative to said audio signal acting as a reference audio signal, or said reference audio signal generated by said phase generator, to provide partial cancellation of both Second-order and Third-order harmonic distortion components using three channels.

30. Apparatus according to claim 24 wherein said phase generator is adapted to generate three versions of said audio signal that are shifted in phase by 60 degrees, 90 degrees and 150 degrees respectively relative to said audio signal acting as a reference audio signal, or said reference audio signal generated by said phase generator, to provide cancellation of both Second-order and Third-order harmonic distortion components using four channels.

31. Apparatus according to claim 24 wherein said phase generator is adapted to generate three versions of said audio signal that are shifted in phase by first, second and third angles relative to said audio signal acting as a reference audio signal, or said reference audio signal generated by said phase generator, to provide cancellation of two orders of harmonic distortion components using four channels.

32. Apparatus according to any one of claim 24 wherein said phase generator includes an analog circuit.

33. Apparatus according to any one of claim 24 wherein said phase generator includes a digital signal processor (DSP).

34. Apparatus according to claim 24 wherein the phase difference is adapted to switch from 90 degrees at a relatively low power level to 60 degrees at a relatively high power level, wherein switching the phase difference from 90 degrees to 60 degrees is configured to occur at a power level chosen such that the switching results in an overall reduction of dominant Second-order harmonic distortion components and dominant Third-order harmonic distortion components.

35. Apparatus according to claim 24 wherein the phase difference transitions gradually from 90 degrees to 60 degrees as power level increases.

36. Apparatus according to claim 24 wherein the phase difference transitions gradually from 90 degrees to 60 degrees as a non-constant function of the frequencies present in the audio signal.

37. A method for processing a signal such as an audio signal that is subject to harmonic distortion components arising along a signal path associated with a system such as an audio system, said method comprising:

generating at least one phase-difference signal being a version of said audio signal that has a constant difference in phase relative to said audio signal acting as a reference audio signal, or a reference audio signal generated by said phase generator, wherein the or each constant phase difference is adapted to provide cancellation of said harmonic distortion components arising along said signal path; and providing an output including at least said audio signal acting as a reference audio signal, or said reference audio signal generated by said phase generator, and the or each version of said audio signal wherein said output is adapted to produce a combined sound that corresponds to said audio signal with harmonic distortion components that are reduced compared to said harmonic distortion components arising along said signal path.

38. A method according to claim 37 wherein said reference audio signal includes a version of said audio signal whose frequency components have a reference phase.

39. Loudspeaker apparatus for managing and/or reducing harmonic distortion components associated with a signal such as an audio signal that is subject to harmonic distortion components arising along a signal path, said apparatus comprising:

a main enclosure including a plurality of substantially-equal compartments;

at least two drivers each having substantially-equal performance parameters and each being housed in a separate one of said equal compartments; and wherein each driver is adapted to be driven via a signal processed according to claim 24 or a method according to claim 37.

40. A loudspeaker apparatus according to claim 39 including two drivers wherein said drivers are adapted to be driven via signals using two channels including a reference channel and a channel having a phase response differing by 90 degrees from the phase response of the reference channel to provide cancellation of Second-order harmonic distortion components.

41. A loudspeaker apparatus according to claim 39 including three drivers wherein said drivers are adapted to be driven via signals using three channels including a reference channel and two other channels having phase responses differing by 60 degrees and 120 degrees respectively from the phase response of the reference channel to provide cancellation of Second-order harmonic distortion components and at least partial cancellation of Third-order harmonic distortion components.

42. A loudspeaker apparatus according to claim 39 including four drivers wherein said drivers are adapted to be driven via signals using four channels including a reference channel and three other channels having phase responses differing by 60 degrees, 90 degrees and 150 degrees respectively from the phase response of the reference channel to provide cancellation of both Second-order and Third-order harmonic distortion components.

43. A loudspeaker apparatus according to claim 42 wherein the drivers are arranged in a rectangular formation such that the reference channel is diagonally opposite to the 150 degrees channel and the 60 degrees channel is diagonally opposite to the 90 degrees channel.

44. A non-transitory data carrier or a non-transitory storage device including or having stored therein a signal processed by apparatus according to claim 24 or a method according to claim 37.

45. A distortion-cancelling audio system comprising:

a phase generator for generating plural versions of an input audio signal including a reference audio signal and other signal versions which are shifted in phase relative to said reference audio signal;

a set of amplifiers for receiving said reference audio signal and said other signal versions having phase-shifted signals and for providing corresponding amplifier outputs; and a set of loudspeakers for receiving the amplifier outputs and for producing acoustic outputs, wherein each amplifier corresponds to an output from the phase generator and each loudspeaker corresponds to an amplifier such that each loudspeaker produces an acoustic output that has constant phase difference relative to the acoustic output of each other loudspeaker, and wherein the loudspeakers are combined into a composite structure such that their acoustic outputs are in close proximity to each other.

46. A distortion-cancelling audio system comprising:

a phase generator for generating four versions of an input audio signal including a reference audio signal and three other signal versions which are shifted in phase by 60 degrees, 90 degrees and 150 degrees respectively relative to said reference audio signal, wherein each signal version is adapted to be stored in a multi-channel format;

a storage medium for storing said four signal versions in said multi-channel format;

a decoder for regenerating said four signal versions from said four stored signal versions;

a set of four amplifiers for receiving said four regenerated signal versions and for producing four amplifier outputs; and a set of four loudspeakers for receiving the four amplifier outputs, wherein the loudspeakers are arranged such that their acoustic outputs are in close proximity to each other.

47. A distortion-cancelling audio system according to claim 46 wherein the loudspeakers are arranged in a rectangular formation such that a reference channel corresponding to said reference audio signal is diagonally opposite to the 150 degrees channel and the 60 degrees channel is diagonally opposite to the 90 degrees channel.

48. A distortion-cancelling audio system comprising:

a phase generator for generating two versions of an input audio signal including a reference audio signal and another signal version which is shifted in phase by 90 degrees relative to said reference audio signal, wherein each signal version is adapted to be stored in a multi-channel format;

a storage medium for storing said two signal versions in said multi-channel format;

a decoder for regenerating said two signal versions from said two stored signal versions;

a set of two amplifiers for receiving said two regenerated signal versions and for producing two amplifier outputs; and a set of two loudspeakers for receiving the two amplifier outputs, wherein the loudspeakers are arranged such that their acoustic outputs are in close proximity to each other.

49. A distortion-cancelling audio system comprising:

a phase generator for generating two versions of an input audio signal including a reference audio signal and another signal version which is shifted in phase by 90 degrees relative to said reference audio signal, wherein each signal version is adapted to be stored in a multi-channel format;

a storage medium for storing said two signal versions in said multi-channel format;

a decoder for regenerating said two signal versions from said two stored signal versions, wherein one regenerated signal is said reference audio signal and the other regenerated signal has a phase difference of 90 degrees;

a further phase generator or phase generators for generating two further phase-difference signals from said two regenerated signal versions, having phase differences of 60 degrees and 150 degrees respectively relative to said regenerated reference audio signal, thereby acquiring four phase-difference signals having relative phases of 0, 60, 90 and 150 degrees;

a set of four amplifiers for receiving the four regenerated phase-difference signals and for producing four amplifier outputs; and a set of four loudspeakers for receiving the four amplifier outputs wherein the loudspeakers are arranged such that their acoustic outputs are in close proximity to each other.

50. A distortion-cancelling audio system according to claim 49 wherein the loudspeakers are arranged in a rectangular formation such that a reference channel corresponding to said reference audio signal is diagonally opposite to the 150 degrees channel and the 60 degrees channel is diagonally opposite to the 90 degrees channel.

* * * * *